United States Patent [19]

Hamilton

[11] Patent Number: 4,522,013

[45] Date of Patent: Jun. 11, 1985

[54] YIELDABLE PLATFORM FOR FOOD WRAPPING MACHINE

[75] Inventor: Glen T. Hamilton, Jacksonville, Tex.

[73] Assignee: GME, Inc., Jacksonville, Tex.

[21] Appl. No.: 509,386

[22] Filed: Jun. 30, 1983

[51] Int. Cl.[3] ..... B65B 11/26; B65B 49/08

[52] U.S. Cl. ..... 53/220; 53/222; 53/226; 53/230

[58] Field of Search ..... 53/220, 221, 222, 226, 53/228, 229, 230, 231

[56] References Cited

U.S. PATENT DOCUMENTS

| | | | |
|---|---|---|---|
| 2,125,024 | 7/1938 | Houpt | 53/222 |
| 3,662,513 | 5/1972 | Fabbri | 53/226 X |
| 4,137,691 | 12/1979 | Takahashi | 53/226 X |
| 4,388,796 | 6/1983 | Zelnick | 53/222 X |

*Primary Examiner*—Robert L. Spruill
*Assistant Examiner*—Michael D. Folkerts
*Attorney, Agent, or Firm*—Jerry W. Mills; Gregory M. Howison

[57] ABSTRACT

A food wrapping apparatus (10) includes a conveyor (12) for passing unwrapped food product (24) to an elevator platform (14). The elevator platform (14) has a plurality of tucking fingers (16) disposed thereon to provide a yieldable platform. When the food product (24) is disposed on the top of the tucking fingers (16), the elevator platform (14) raises the food product (24) upwards into a layer of wrapping material (18). Tucking arms (36) and (38) are operable to pass under the food product (24) disposed on the top of the tucking fingers (16) and pull the wrapping material (18) therearound. The tucking fingers (16) rotate on longitudinal rods (28) to allow the tucking arms (36) and (38) to pass thereover without disturbing the food product (24). Each of the tucking fingers (16) has a tapered leading end (66) and a tapered trailing end (64). The tapered leading end (66) is designed to mesh with the tapered trailing end (64) of an adjacent one of the fingers (16). The tapered ends allow the meshing of two fingers (16) to occur without binding and without breakage.

1 Claim, 6 Drawing Figures

YIELDABLE PLATFORM FOR FOOD WRAPPING MACHINE

TECHNICAL FIELD

This invention pertains in general to food wrapping machines and, more particularly, to the supporting platform with a yieldable surface for wrapping the food products thereon.

BACKGROUND OF THE INVENTION

Commercial food wrapping machines provide high speed packaging for various types of food products. The machines utilize a conveyor to transfer the food product to a wrapping station where the actual high speed wrapping operation occurs. The food product is supported on an elevator platform that raises the food into contact with a layer of stretched wrapping film. After the food product has been elevated into contact with the wrapping material, a group of tucking arms folds the wrapping material under the food product to complete the wrapping procedure. The tucking arms are then removed from under the wrapped food product and the food product is pushed off of the elevator platform and on to a finished wrapped product conveyor for removal thereof. The elevator platform is then lowered and another package of unwrapped food product disposed thereon to repeat the procedure.

When the tucking arms fold the wrapping material under the food product, it is necessary that the elevator platform yield to these arms. To facilitate the tucking operation, the elevator platform is fabricated with a number of spring loaded tucking "fingers" that rotate in the direction of the tucking arm motion to allow the tucking arms to displace them. Since the food wrapping process in a production environment wraps at a rate of approximately one package every 0.1 second, it is necessary for the yielding fingers to rotate away from the tucking arms and then return to their original position at a rate exceeding the food wrapping time. Since a plurality of these fingers are normally utilized in parallel rows, it is necessary for them to mesh to provide a relatively continuous platform. In meshing, prior art fingers have exhibited a tendency to "bind" during the packaging process, that is, the leading edge of one of the fingers contacts the trailing edge of another finger. When this happens, the finger normally breaks. Although the fingers themselves are relatively inexpensive, it is necessary to stop the machines, remove and replace the damaged fingers and then begin operation again. This takes approximately twenty to thirty minutes. This "down time" in a production environment can result in a great deal of expense since the "front end" costs for these types of machines necessitates their running at virtually 100% capacity to turn the profit in addition to the fact that the machine keeps around twenty support personnel occupied. Therefore, the time required to replace the fingers becomes substantial with respect to a profitable business operation.

Therefore, there exists a need for an elevator platform that has a yieldable surface that requires less maintenance, thereby resulting in less down time.

SUMMARY OF THE INVENTION

The present invention disclosed and claimed herein comprises a platform for supporting food to be wrapped in a food packaging apparatus utilizing tucking arms to wrap the food. The food packaging apparatus includes a base and a plurality of first pivoting members, each of the first pivoting members pivoting in adjacent parallel planes that are perpendicular to the plane of the base and spaced apart from adjacent ones thereof a predetermined distance. The apparatus also includes a plurality of second pivoting members, each of the second pivoting members pivoting in a plane parallel to the pivoting planes of the first pivoting members, the second pivoting member positioned to pivot between two adjacent ones of the first pivoting members. The first and second pivoting members form a yieldable platform for receiving the food product to be packaged on the portions of the pivoting members farthestmost from the pivoting points thereof. The second pivoting members have leading edges thereof that are tapered and the first pivoting members have the trailing edges thereof tapered such that the leading edges of each of the second pivoting members mesh between the trailing edges of two adjacent ones of the first pivoting members. The trailing edges of the first and second pivoting members are positioned such that the tucking arm makes contact therewith to cause pivoting thereof.

In another embodiment of the present invention, a spring is provided about the pivoting point of the first and second pivoting members to return them to the original position to form the platform for receiving the food products. The pivoting members are mounted on a longitudinal rod and in parallel rows such that all of the first pivoting members pivot synchronously and all of the second pivoting members pivot synchronously. This allows all of the pivoting members that pivot synchronously to pivot when the tucking arm strikes only one of the pivoting members.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
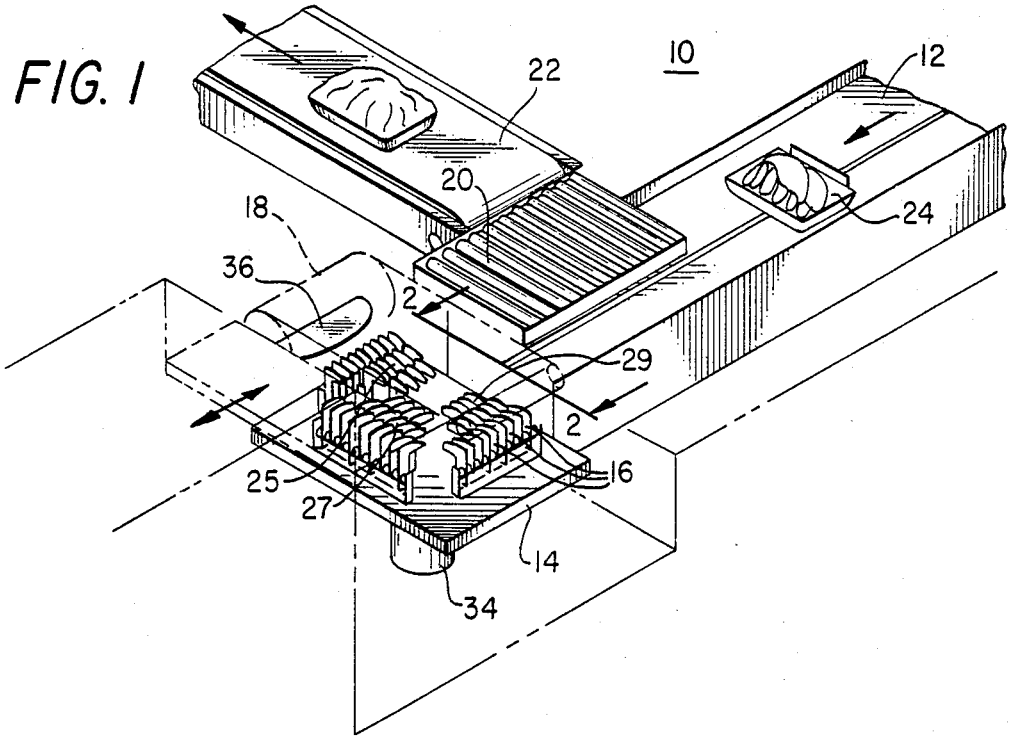
FIG. 1 illustrates a perspective view of a food wrapping apparatus with the tucking fingers of the present invention in place.

Referring now to FIG. 1, there is illustrated a perspective view of a food wrapping apparatus 10 utilizing the present inventive concept. The food wrapping apparatus 10 includes a food product conveyor 12 for conveying unwrapped food product to an elevator platform 14. The elevator platform 14 supports the food on a plurality of tucking fingers 16 for reciprocation along a direction perpendicular to the surface of the elevator platform 14. A roll of wrapping material 18 is disposed adjacent the elevator platform and stretched thereover such that the unwrapped food product that is disposed on top of the elevator platform 14 can be pressed upward against the wrapping material 18. The wrapping material 18 is shown in phantom lines for simplicity purposes only. The food wrapping apparatus 10 is generally of the type manufactured by Weldtron Corporation.

After the food product has been wrapped, as will be described hereinbelow, it is pushed onto a roller conveyor 20 by an external pusher (not shown) and then onto a conveyor 22 for moving the wrapped food product to a remote location. The elevator platform 14 then is lowered back to the plane of the conveyor 12 to receive another portion of unwrapped food product and then the wrapping process is repeated.

Figure 2:
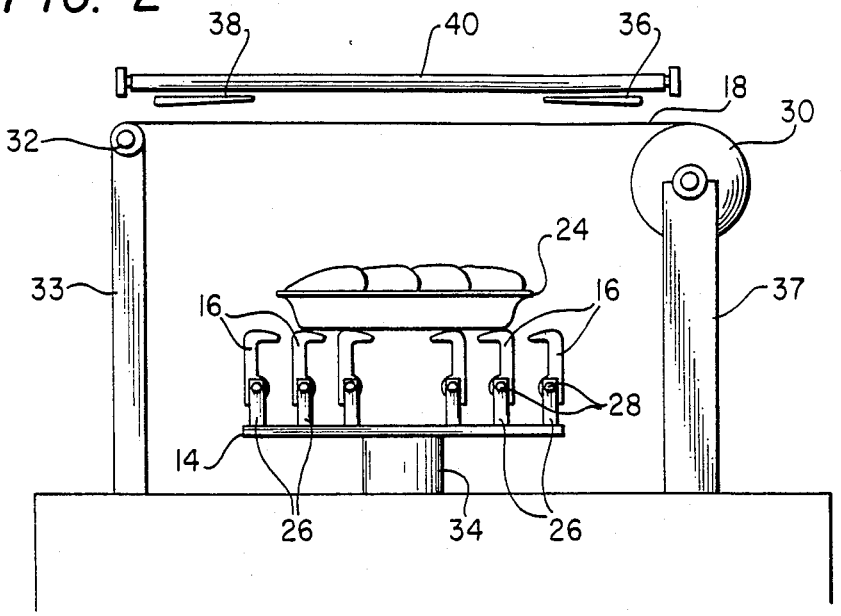
FIG. 2 illustrates a side view of the elevator platform with unwrapped food products in place.
Figure 3:
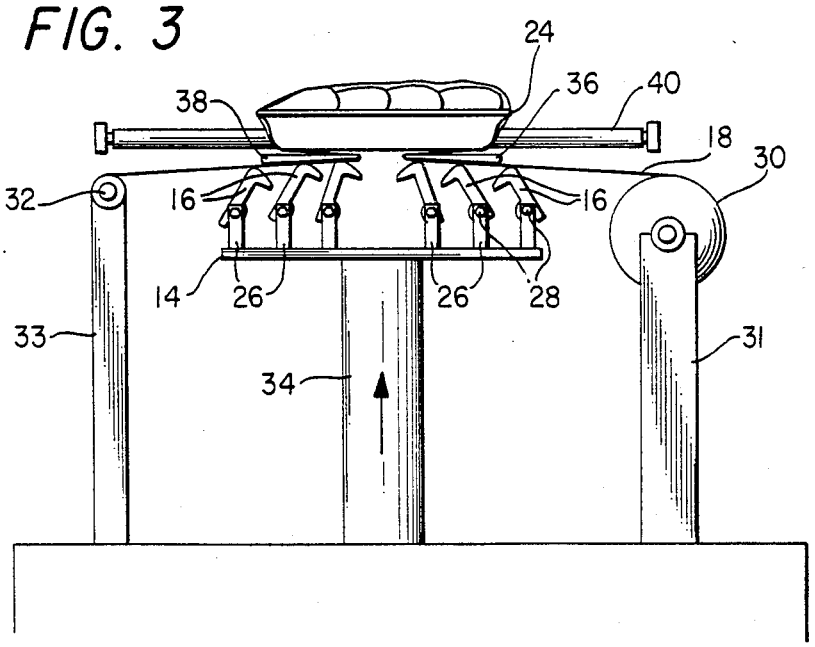
FIG. 3 illustrates an isolated side view of the elevator platform showing the tucking arms disposed between the food product and the tucking fingers.

Referring now to FIGS. 2 and 3, there is illustrated a side view of the elevator platform 14 taken along line 2—2 of FIG. 1 and shown in both the lowered and raised positions. In FIG. 2, a package of unwrapped food product 24 is disposed on top of the fingers 16. The fingers 16 are arranged in groups parallel rows and each row of fingers is supported on a respective bracket 26 that has a longitudinal rod 28 disposed therethrough for allowing the pivoting motion of the fingers 16. As shown in FIG. 1, there are three groups 25, 27 and 29 of fingers driving the rows thereof oriented at right angles to each other around the periphery of the elevator platform 14.

The wrapping material 18 is disposed on a roll 30 and is stretched over the top of the unwrapped food product 24 to a secondary roller 32. The roll 30 is supported on a bracket 31 and the secondary roller 32 is supported on a bracket 33.

As illustrated in FIG. 3, reciprocation upwards of the elevator platform 14 on a reciprocating shaft 34 places the food product 24 in contact with the wrapping material 18. At this point, a pair of swiveling tucking arms 36 and 38 pivot from a position external to the surface plane of the elevator platform 14 and above the layer of wrapping material 18. The tucking arms 36 and 38 are positioned with respect to the platform 14 such that they move under the food product 24 and pull the layer of wrapping material 18 therewith. In order to prevent the food product 24 from being lifted by the tucking arms 36 and 38, the fingers 16 pivot out of the way to allow the tucking arms 36 and 38 to pass under the food product 24 and pull the layer of wrapping material 18 under the bottom of the food product 24 to effect a complete wrap thereof. The tucking arms 36 and 38 contact the tucking fingers 16 in the groups 25 and 29, respective, as shown in FIG. 1. Although not shown, a third tucking arm moves under the food product 24 to contact the group 27 of tucking fingers 16. For clarity purposes, only the tucking arms 36 are illustrated in FIG. 1.

After the food product 24 has been wrapped, the tucking arms 36 and 38 are retracted from under the wrapped food product 24 and the fingers 16 return to their original position to support the wrapped food product 24. The wrapped food product 24 is then pushed off of the top of the fingers 16 with the elevator platform 14 in a raised position by a pusher 40. The pusher 40 moves the wrapped food product 24 onto the rollers 20 for transfer to the conveyor 22.

Figure 5:
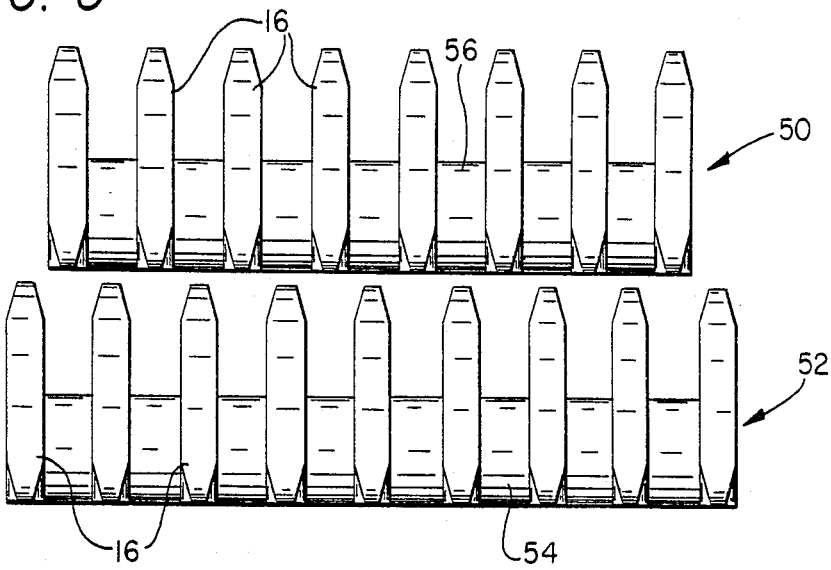
FIG. 5 illustrates a top view of the view illustrated in FIG. 4.
Figure 6:
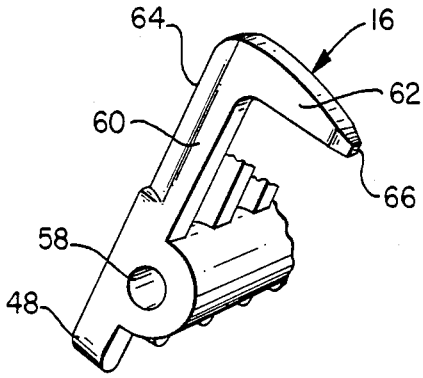
FIG. 6 illustratates a perspective view of one of the tucking fingers.

Referring now to FIGS. 5 and 6 there are illustrated side and top views, respectively, of a section of the fingers 16. As described above, the fingers 16 are mounted on longitudinal rods 28 for pivoting thereabout. The longitudinal rods 28 are fixed with respect to the mounting brackets 26 by fasteners or bolts 42. A spring 44 is disposed around the longitudinal rod 28 and has one end thereof attached to the fingers 16 and the other end thereof attached to the bracket 26. The spring is operable to provide a counterforce to the rotation of the fingers 16 in the direction of motion of the tucking arms 36 during the wrapping process. When the tucking arm 36 is removed, the fingers 16 are pivoted in the opposite direction by the spring 44 to return to their normal position. A stop 46 is disposed on the bracket parallel to the longitudinal rod 28 to contact a protrusion 48 on the end of the fingers 16 nearestmost the elevator platform 14.

FIG. 5 illustrates a top view of a portion of one of the groups 25, 27 and 29 of the fingers 16 illustrating two longitudinal rows 50 and 52. The fingers 16 in the row 52 are mounted on a common bearing 54 as a one piece molded unit that allows all fingers 16 thereon to rotate synchronously, that is, movement of one finger 16 results in movement of the other fingers 16 mounted on the common bearing 54. The fingers 16 in row 50 are mounted on a common bearing 56 and are of a similar one piece construction to the fingers 16 and the bearing 54 in row 54. The fingers 16 and the common bearings that they are attached to are fabricated from a material such as polyethylene or a similar plastic material suitable for injection molding.

Referring now to FIG. 6, there is illustrated a perspective view of one of the fingers 16. The finger 16 has an orifice 58 disposed therethrough to receive one of the longitudinal rods 28. The orifice 58, with reference to FIG. 5, passes through the common bearing portion thereof. The fingers 16 include a longitudinal member 60 that is integrally molded with the bearing portion and orifice 58 and extends radially outward from the orifice 58. The protrusion 48 is also integrally molded with the fingers 16. However, there only needs to be between three to four of the protrusions 48 per row 50 or 52 of the fingers 16.

The longitudinal member 60 in the normal position is vertical with respect to the surface of the platform 14. A horizontal member 62 is disposed on the distal end of the longitudinal member 60 and integrally molded therewith. The horizontal member 62 is disposed such that only one end thereof extends outward from the axis of the longitudinal member 60 with the remaining end thereof molded flush with the side of the longitudinal member 60. The distal surface of horizontal member 62 with respect to the pivot point is arcuate in shape. The finger 16 has a trailing edge 64 on the longitudinal member 60 and a leading edge 66 on the distal end of the horizontal member 62. The leading edge 66 "leads" the direction of rotation thereof and the trailing edge 64 "lags" the direction of rotation.

As best illustrated in FIG. 5, the fingers 16 in the adjacent rows 50 and 52 are oriented along the longitudinal rods 28 such that they are "staggered". This allows the fingers 16 molded on the bearing 54 in row 52 to rotate towards the fingers 16 on the bearing 56 in row 50 and mesh therewith. The leading edge 66 of each of the fingers 16 is tapered such that meshing of the fingers is facilitated. This taper is comprised of a taper or facet on each side of the distal end of the horizontal member 62 that is disposed at an angle of approximately 15° with the lateral sides of the horizontal member 62. The taper covers approximately 25% of the overall length of the horizontal member thereon. The trailing edge 64 of the fingers 16 is also tapered with similar dimensions and extending partially along the lateral edge thereof. It is necessary for the taper on the trailing edge 64 to extend downward towards the orifice 58 as the meshing finger in the adjacent row thereto rotates downward along the longitudinal axis of the longitudinal member 60. The tapered surfaces on both the trailing and leading edges 64 and 66, respectively, prevent "binding" of the fingers 16 on adjacent rows during meshing.

Figure 4:
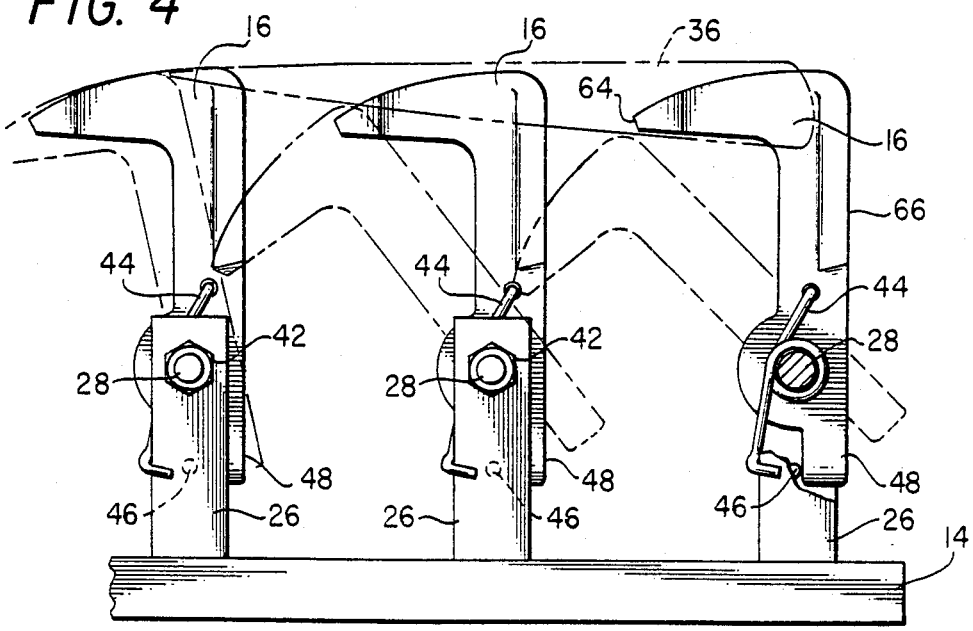
FIG. 4 illustrates an expanded side view of the tucking fingers.

Referring further to FIG. 4, the tucking arm 36 is illustrated in cross section with phantom lines in a position such that the fingers 16 are partially rotated downward. When the tucking arm 36 initially contacts the fingers 16, the first finger is contacted on the trailing edge 64 thereof and rotates downward about the longitudinal rod 28 to mesh with the adjacent finger 16 in the adjacent row. The tucking arm 36 then proceeds to contact the trailing edge of the subsequent adjacent fingers until all the fingers in adjacent rows are rotated downward. Since this operation occurs at a rate of approximately once every 0.1 seconds, the fingers 16 must mesh and unmesh at a slightly faster rate. At this rate, there are certain inertial forces that are present which can cause slight deformations and lateral movements of the fingers 16 with respect to the axis of the rods 28. Without the taper on the trailing edge 64 and the leading edge 66, this lateral movement of the finger may cause the leading edge 66 of one finger to strike the trailing edge 64 of a finger 16 on an adjacent row. When this happens, there is a high probability of increased wear and/or breakage of the fingers 16. The use of the tapered trailing and leading edges prevents the leading edge 66 of a finger 16 striking the trailing edge of a finger 16 in an adjacent row.

In summary, there has been provided a food wrapping apparatus having a yielding platform for supporting unwrapped food products thereon. A tucking arm designed to wrap material about the food product passes under the food product and the platform yields in response thereto. The platform then returns to a normal position when the arm is removed. The yielding platform is formed with a plurality of pivoting fingers that mesh upon pivoting in response to the tucking arm passing thereover. The trailing edge and leading edge of the tucking fingers are tapered to allow meshing thereof and prevent binding. During high speed operation of the food wrapping apparatus, the tapered edges allow the tucking fingers to mesh without binding which can result from the leading edge of one of the tucking fingers contacting the trailing edge of a tucking finger in an adjacent row during meshing.

Although the preferred embodiment has been described in detail, it should be understood that various changes, substitutions and alterations can be made therein without departing from the spirit and scope of the invention as defined by the appended claims.

What is claimed is:

1. A food packaging apparatus, comprising:

a product food conveyor for moving unwrapped food products;

a wrapped food product conveyor for moving wrapped food products;

a wrapping dispenser for containing wrapping;

an elevator for moving the food products proximate said dispenser from said product food conveyor, said elevator having a platform disposed thereon for receiving the food product;

a tucking arm for causing said wrapping to enclose the food product therearound, said tucking arm extending under the food product;

means for moving the wrapped food product from said platform to said wrapped food product conveyor;

said platform having:

a base, a plurality of longitudinal rods and means to mount said rods to be disposed parallel to said base and supported therefrom around the periphery of said base, said longitudinal rods arranged in groups and oriented so that the rods within a common group are substantially parallel to each other and are oriented at right angles to the rods in each of the groups adjacent thereto;

each of said longitudinal rods having a plurality of pivoting members mounted thereon in spaced apart relationship for rotating thereabout, each of said pivoting members having;

a bearing for rotation about said longitudinal rod, a radial member having one end thereof disposed on said bearing, the distal end thereof for traversing an arcuate path and a horizontal member disposed on the distal end of said radial member in a plane tangential to the rotational path of said radial member, said horizontal member having tapered trailing and leading edges, the surface of said horizontal member distal to said bearing having an arcuate shape;

said pivoting members on each of said longitudinal rods disposed to pivot in the direction of motion of said tucking arm to mesh with pivoting members on adjacent ones of said rods when said tucking arm passes under the food product and contacts the trailing edges of said pivoting members, the tapered trailing and leading edges preventing binding upon meshing of said pivoting members, all of said pivoting members on one of said longitudinal rods pivot synchonously such that pivoting of one of said pivoting members causes pivoting of all of said pivoting members on a common longitudinal rod; and a spring disposed on each of said longitudinal rods and attached to said pivoting members to return said pivoting members to their original position after withdrawal of said tucking arm.

* * * * *